United States Patent [19]

Kazz

[11] Patent Number: 4,875,300

[45] Date of Patent: Oct. 24, 1989

[54] TRACK SHOE WITH A DETACHABLE SPIKE PLATE BY THE USE OF PLASTIC SPIKES

[76] Inventor: Michael Kazz, 931 N. Norris, Tucson, Ariz. 85719-4948

[21] Appl. No.: 228,732

[22] Filed: Aug. 5, 1988

[51] Int. Cl.[4] ..... A43B 5/00

[52] U.S. Cl. ..... 36/134; 36/114

[58] Field of Search ..... 36/67 A, 67 D, 114, 36/124, 126, 127, 128, 129, 134

[56] References Cited

U.S. PATENT DOCUMENTS

| | | | |
|---|---|---|---|
| 2,177,155 | 10/1939 | Shapiro | 36/134 |
| 2,192,150 | 2/1940 | Pierce | 36/134 |
| 2,315,874 | 4/1943 | Sabel | 36/134 |
| 2,918,733 | 12/1959 | Anderson | 36/134 |
| 4,561,197 | 12/1985 | Misevich | 36/134 |

*Primary Examiner*—Werner H. Schroeder
*Assistant Examiner*—Diana L. Biefeld

[57] ABSTRACT

This invention is a track shoe comprised of an upper, an outsole and a spike plate. The outsole, made of an elastic material, has a bottom surface similar to the bottom surface of the spike plate. The bottom surface of the outsole, in addition, has spike receiving sockets where plastic spikes fit in and attach a detachable spike plate. The spike plate has seven apertures to allow for the insertion of seven plastic spikes which hold the spike plate to the outsole. The spike plate can be replaced by exchanging spike plates. The plastic spikes are designed to be lighter and more cost effective than steel ones, yet as easy to replace by the use of a common spike wrench.

14 Claims, 2 Drawing Sheets

TRACK SHOE WITH A DETACHABLE SPIKE PLATE BY THE USE OF PLASTIC SPIKES

BACKGROUND OF THE INVENTION

The present invention involves athletic foot wear but specifically track shoes that have a spike plate made of a resilient material. The present invention's purpose is aimed at reducing the weight of track shoes by using a detachable spike plate and plastic track spikes. This invention is of the most economical design since it uses both replaceable plastic spikes and spike plates. The track shoe can also be used without the attachment of a spike plate. This is accomplished by the direct insertion of the spikes to the outsole, thereby greatly decreasing the track shoe's weight. The former situation may not be suitable for training purposes, but rather for competition purposes. Finally, the shoe has flexibility in changing the color arrangement of the spikes and spike plate. Since they are of a synthetic material, they can be manufactured in any color.

DESCRIPTION OF THE PRIOR ART

In general, track shoes using plastic spikes cannot rely on the same successful means accomplished by steel spikes which utilize the screw insert manner of spike insertion into a spike plate. This is because the threads on a steel spike are too thin for a synthetic material to maintain their original shape. The threads on steel spikes inserted into steel receiving sockets work well because the threads are very hard and will not deform as threads made from a synthetic material would. A second reason for unsuccessful plastic spikes is deformation due to thermal expansion of the synthetic material. Materials such as nylon have relatively high coefficients of thermal expansion, which intern create a poor juncture between the spikes and their holding sockets. Due to the reasons mentioned, the development of plastic spikes in track shoes have resulted in heavier, more awkward designs for the runner.

Previously, in U.S. Pat. No. 2,745,197 by Holt, it was suggested that a nylon spike could be mounted in a recess with each spike having a plug, an end and a intermediate flange. These nylon spikes are held in retaining sockets that allow for the snap removal of the spikes and a sturdy hold of the spike since as the runner hits the ground the flanges are spread by the resulting forces, thus holding the spike more in the tap sole (in this invention's context: spike plate). Since the preferred material of this patent is nylon, the plastic midsole and spikes have a high coefficient of thermal expansion and will, therefore, become easily deformed with normal changes in temperature. This forces the spike to loosen and fall out with little effort of the shoe striking the ground. The present invention is completely opposite in its method and materials being used. Nylon will not be used in the outsole, spike plate or spikes of the proposed invention, but rather copolymers. Also, the proposed invention will use a screw insert means to join plastic spikes with their respective sockets. This will require the spikes to have wide threads and not flanges. The holding ability of plastic threaded spikes to the spike plate are far superior in lateral support than spikes held with a snap retaining means. With Holt's track shoe, the plastic spike plate and spikes deform readily with use, which over a period of minimal track use will force the retaining effect of the spike's flanges to fail, due to the deformation of plastic experienced in the surrounding plastic. The shoe is thus wasted since the spike plate is permanently attached to the outsole. The present invention has the ability to replace the spike plate and the spikes so that the entire shoe is not sacrificed due to structural failure of the spikes or spike plate. The proposed invention utilizes wider threads than those used in any metal threaded spikes, since it would be unfeasible to use plastic threads under 1 mm to retain the spikes.

In U.S. Pat. No. 3,812,605 by Kaestle, plastic gripping elements (spikes) are used. These spikes are held to the spike plate are with steel locking pins which run through the spikes and across the interior of the sole, and are held by a threaded end. The holes in the base of the spikes are under a great shearing force that deforms their shape during running. Stress is introduced into the plastic during running that does this to the plastic parts. These parts, therefore, are in need of continual replacement. The current invention uses wide plastic threads that securely hold the spike into the spike plate and the outsole.

Moreover, the steel pins used in Kaestle's invention are far too heavy for use in a track shoe that requires the most lightweight design. The pins also run horizontally across the shoe, thereby restricting the positions of the spikes to single horizontal planes. This restricts the proper positioning of spikes based on the requirement of the individual runner.

SUMMARY OF THE INVENTION

The present invention would preferably be comprised of an upper formed from a last (California Process) that is partly or entirely made of nylon, leather or some other man-made material. This upper is secured to an outsole made of an injection-molded plastic that preferably has a high elasticity and is compressible, since this portion comes in almost direct contact with the runner's foot. This may be secured to the upper by stitching or adhesive binding means. A plastic spike plate of a harder, more elastic material is secured to the outsole by the screw insert means of threaded plastic spikes. The plastic spikes are secured to the outsole by screwing them through both the spike plate and into the outsole. The spike is inserted through the entire thickness of the spike plate but the spike goes about ¾ the thickness of the outsole. This allows for the detachability of the spike plate. The bottom of the spike plate has projections that improve surface contact with the running surface. On the top surface of the spike plate, which faces the outsole, the spike plate has perforations molded to hold the projections from the outsole's plastic surface. The bottom surface of the outsole follows a similar pattern of projections as the bottom surface of the spike plate and thereby fits simultaneously into the spike plate when attached with spikes.

It is an object of this invention to reduce the weight of existing track shoes with the successful incorporation of plastic spikes normally attached to the shoe's spike plate, but which can be directly attached to the shoe's outsole, thereby eliminating the large mass of the spike plate.

It is another object of this invention to extend the use of a track shoe by the use of a replaceable spike plate that normally wears prematurely.

Another object of this invention is to expand the range of applications in a track shoe, as well as its colors, by the use of a replaceable spike plate that can vary in color, material and design, as required by various track and field events.

Still another object of this invention is to reduce the costs of track spikes by successfully using plastic as a material, to replace the more expensive metal ones.

DESCRIPTION OF THE PREFERRED EMBODIMENTS

Figure 1:
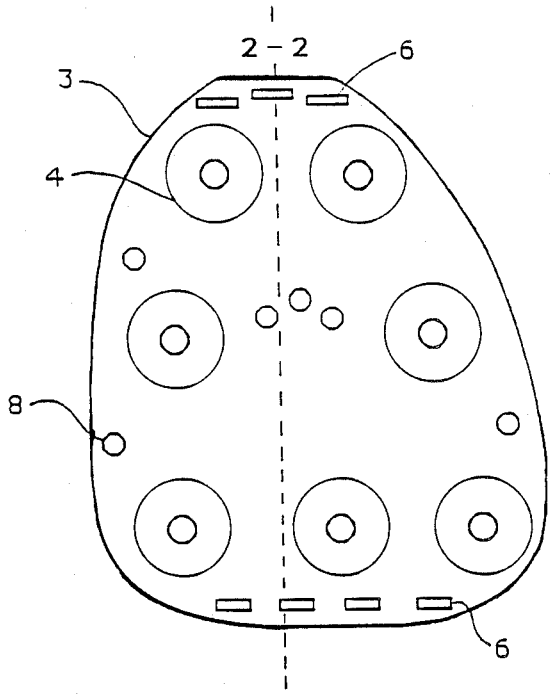
FIG. 1 is a bottom view of the spike plate of the track shoe as it would be attached to the track shoe's outsole.

A spike plate made of an elastic copolymer comprised of a Shore A hardness of 85 to 120 is seen in FIG. 1. The spike plate 3 is comprised of a platform, which is made by a plastic injection mold process. This platform preferably is at least one eighth of an inch in thickness but not greater than one fourth of an inch in thickness. This spike plate 3 has plastic spikes 4 mounted to it. The plastic spikes 4 are comprised of a very hard plastic having a Shore A hardness of 150 to 180 and a low coefficient of thermal expansion. The spikes 4 are positioned throughout the spike plate geographically to aid in the correct bio-mechanical contact for the runner, depending on the event. Conically shaped projections 8, which are integrated during the molding of the spike plate 3, have two purposes. The first is to help the runner in lateral stability and traction. The second purpose is to align the outsole 2 up with the spike plate 3 for an easy means of replacing the spike plate 3. The chevron shaped projections 6 are made in the same fashion as the conical projections 8. These chevron projections 6 offer an additional gripping means.

Figure 2:
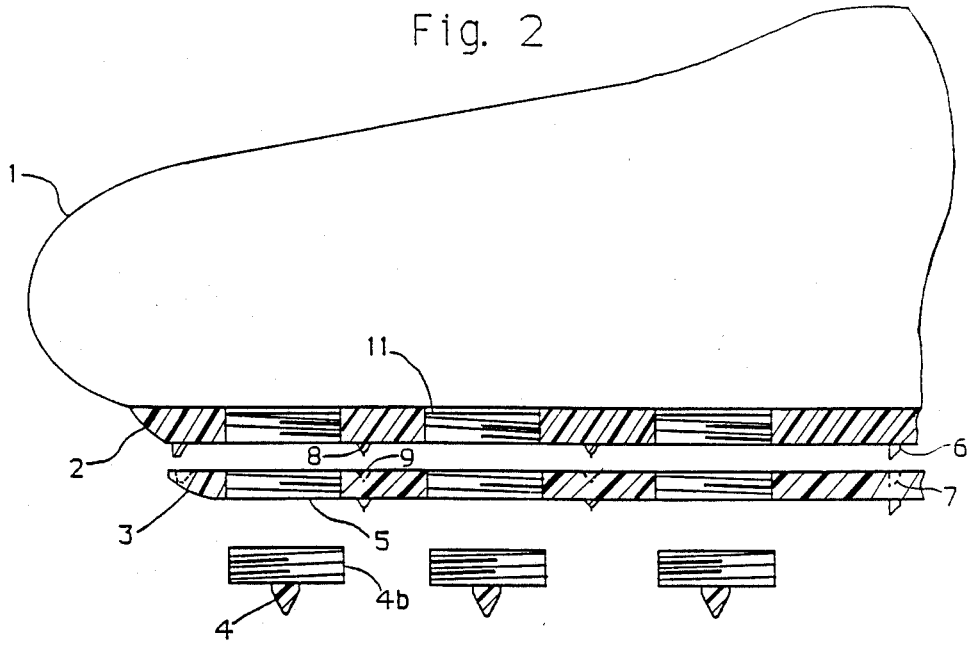
FIG. 2 is a horizontal section view taken from the line 2—2 of FIG. 1 with the spike plate and the spikes removed.

FIG. 2 is a cross section taken from the line 2 to 2 in FIG. 1. This cross section does not extend the entire longitudinal length of the spike plate 3. The outsole of the track shoe 2 is comprised of a resilient plastic that encompasses the entire bottom surface of the track shoe that makes contact with the ground during running. This plastic is not as hard as the plastic used in the spike plate 3 and has a Shore A hardness of 50 to 90. The outsole 2 is comprised of a softer plastic than the spike plate 3, so it can better disperse the shock forces felt by the foot hitting the ground. The outsole 2 is injection molded and attached to the upper 1 by adhesive binding or by stitching. The outsole 2 is detached from the spike plate 3 in FIG. 2 to detail its components. Conical projections 8 are shown in FIG. 2, as well as, their receiving sockets 9. These receiving sockets 9 are for the purpose of lining up the spike plate 3 with the outsole 2. The same is true for the chevron projections 6 and their receiving sockets 7. The plastic spikes 4 are attached to their receiving sockets 5 by a screw insert means that utilizes the threads 4*b* located on the spikes 4. The spikes 4 hold the spike plate 3 to the outsole 2 by their insertion into the outsole 2. The spikes 4 are of a length equivalent to the thickness of the spike plate 3 at the apertures 5 and the socket within the outsole 11.

Figure 3:
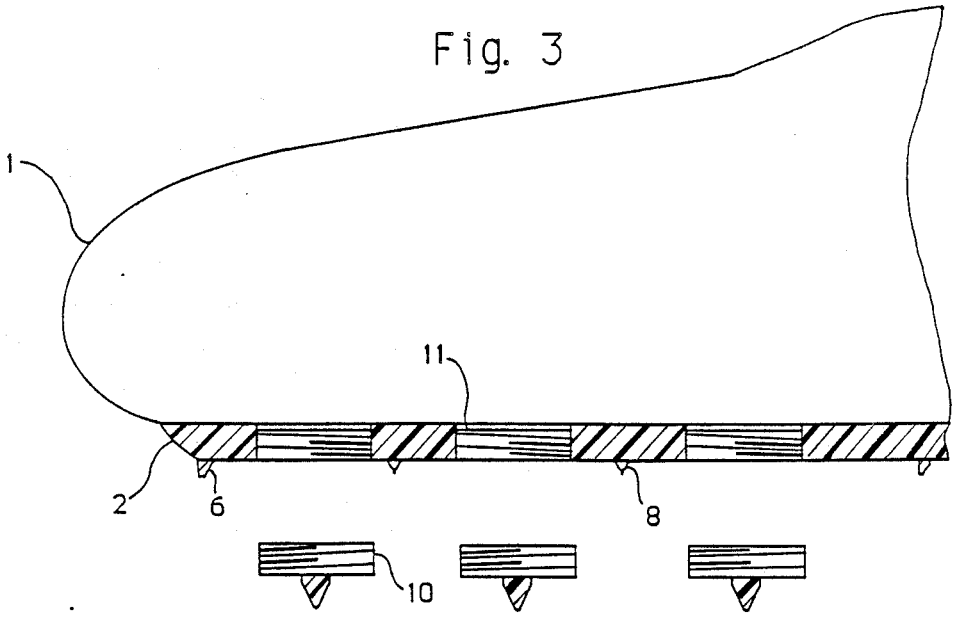
FIG. 3 is the same represented view as in FIG. 2, but with the spike plate removed and the shortened spikes inserted into the outsole.

In FIG. 3 the outsole 2 is attached to the upper 1 and has short plastic spikes 10 to fit directly into the outsole 2. The short spikes 10 have a thinner threaded portion than the previously mentioned spikes 4 so they can be inserted into the outsole 2 in order to attach by screwing means into the receiving sockets within the outsole 11. The conical projections 8 and the chevron projections 6 are exposed to aid in traction for the track shoe.

I claim:

1. A track shoe with an outsole composed of a synthetic material with a low coefficient of thermal expansion such as an elastomer co-polymer or the like, the outsole having a plurality of threaded openings wherein the threads are 1.0 mm to 4.0 mm in width and a plurality of spikes mounted in the threaded openings.

2. The track shoe of claim 1 further including a spike plate mounted adjacent to the outsole, the spike plate having holes therein, the threads having a width between 1.0 mm and 4.0 mm aligned with the openings in the outsole such that the spikes are engaged with both the spike plate and the outsole.

3. The track shoe of claim 2 wherein the spike plate is formed of a synthetic material such as an elastomer co-polymer or the like with a Shore A hardness of 85 to 120.

4. The track shoe of claim 1 wherein the outsole is formed of a synthetic material with a Shore A hardness of 50 to 90.

5. The track shoe of claim 4 further including a spike plate mounted adjacent to the outsole, the spike plate having holes therein wherein the outsole contains projections for aligning the outsole with the spike plate for its attachment with spikes.

6. The track shoe of claim 5 wherein the projections are made of the same material as the outsole.

7. The track shoe of claim 2 wherein the spike plate contains spikes comprised of threaded sides that are wider than 1.0 mm in width but less than 4.0 mm in width.

8. The track shoe of claim 7 wherein the spikes are made of a plastic with a Shore A hardness of 150 to 180.

9. The track shoe of claim 7 wherein the spikes provide for a retaining means for a spike plate.

10. A track shoe having an outsole comprised of a synthetic material that has a low coefficient of thermal expansion, the outsole having a plurality of threaded openings therein; a plurality of spikes mounted in the threaded openings; a spike plate mounted adjacent the outsole, the spike plate having threaded holes therein aligned with the openings in the outsole such that the spikes are engaged with both the spike plate and the outsole; and the outsole being formed of a synthetic material with a Shore A hardness of 50 to 90 and containing projections for aligning the outsole with the spike plate for its attachment with spikes.

11. The track shoe of claim 10 wherein the projections are made of the same material as the outsole.

12. The track shoe having an outsole comprised of a synthetic material that has a low coefficient of thermal expansion, the outsole having a plurality of threaded openings therein; a plurality of spikes mounted in the threaded openings; a spike plate mounted adjacent to the outsole, the spike plate having threaded holes therein aligned with the openings in the outsole such that the spikes are engaged with both the spike plate and the outsole; and the spikes comprising threaded sides that are wider than 1.0 mm in width but less than 4.0 mm in width.

13. The track shoe of claim 12 wherein the spikes are made of a plastic with a Shore A hardness of 150 to 180.

14. The track shoe of claim 12 wherein the spikes provide for a retaining means for a spike plate.

* * * * *